US006181220B1

(12) United States Patent
Meder

(10) Patent No.: US 6,181,220 B1
(45) Date of Patent: Jan. 30, 2001

(54) METHOD FOR REDUCING ELECTRICAL DISCHARGE IN A MICROWAVE CIRCUIT, AND A MICROWAVE CIRCUIT TREATED BY THE METHOD

(75) Inventor: Martin G. Meder, Catasauqua, PA (US)

(73) Assignee: Lucent Technologies, Inc., Murray Hill, NJ (US)

( * ) Notice: Under 35 U.S.C. 154(b), the term of this patent shall be extended for 0 days.

(21) Appl. No.: 09/294,779

(22) Filed: Apr. 19, 1999

(51) Int. Cl.[7] ..... H01P 3/12
(52) U.S. Cl. ..... 333/99 R; 333/99 MP
(58) Field of Search ..... 333/99 R, 99 MP

(56) References Cited

U.S. PATENT DOCUMENTS 4,374,367 * 2/1983 Forterre ..... 333/24.1
4,639,379 * 1/1987 Asai et al. ..... 427/40
4,866,231 * 9/1989 Schneider ..... 219/10.55 A

* cited by examiner

*Primary Examiner*—Justin P. Bettendorf
(74) *Attorney, Agent, or Firm*—Duane Morris & Heckscher LLP; Steven E. Koffs

(57) ABSTRACT

A microwave circuit includes a waveguide, an e-bend, an h-bend, a magic tee, a connector, a coupler, a window, an adaptor, a horn, a switch, a transmitter, or an amplifier circuit. The microwave circuit has a metal surface. A fluid layer is deposited on the metal surface containing either a silicone or a silicone precursor. The fluid may be a volatile solvent containing about 0.5 percent silicone. The fluid may contain a mercapto functional copolymer, and may be dimethyl-co-methylmercaptopropyl siloxane. The fluid may be applied by brushing or dipping. Alternatively, the silicone or silicone precursor may be sprayed on by: bubbling nitrogen through a liquid containing the silicone or silicone precursor to saturate the nitrogen, and blowing the saturated nitrogen across the metal surface of the microwave circuit to deposit the silicone precursor thereon. The liquid may contain dimethyldimethoxysilane and dimethylmercapto-propyldimethoxysilane. After applying the fluid containing the silicone or a silicone precursor, an optional waiting step may be included, before transmitting microwave energy through the microwave circuit.

14 Claims, 3 Drawing Sheets

METHOD FOR REDUCING ELECTRICAL DISCHARGE IN A MICROWAVE CIRCUIT, AND A MICROWAVE CIRCUIT TREATED BY THE METHOD

FIELD OF THE INVENTION

The present invention relates to the field of high power microwave devices.

DESCRIPTION OF THE RELATED ART

High power microwave circuits may include waveguides, switches, elbows, and the like. These devices have maximum power limits imposed by "multipaction." Multipaction refers to electrical discharges in the microwave device that initiate at surface discontinuities where the potential of the e-field is higher than the surrounding surface.

A method of reducing or eliminating these electrical discharges is desired.

SUMMARY OF THE INVENTION

The present invention is a method of treating a microwave circuit having a metal surface, including: selecting a substance from the group consisting of a silicone and a silicone precursor, and applying a fluid containing the selected substance to the metal surface of the microwave circuit.

According to another aspect of the invention, a microwave circuit has a metal surface. The surface has applied thereon a fluid containing either a silicone or a silicone precursor.

DETAILED DESCRIPTION

The present invention is a method for treating a microwave device, and a microwave device treated by the method. The method comprises selecting and applying a silicone or one or more silicone precursors to a microwave device, to form a silicone coating on the device which reduces or prevents electrical discharges in the device.

Figure 1:
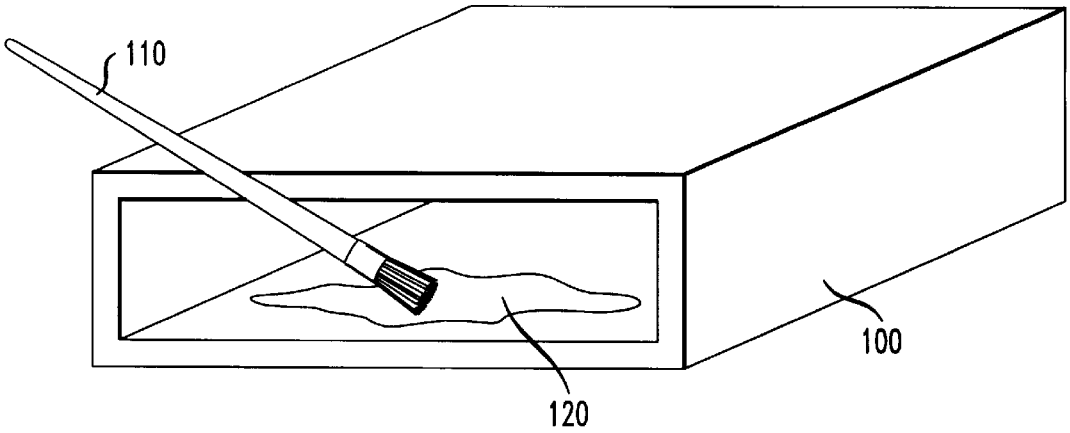
FIG. 1 shows application of a silicone layer to a microwave device by brush, in an exemplary method according to the invention.

FIG. 1 shows an exemplary method of treating a microwave circuit 100 having a metal surface. A substance is selected from the group consisting of a silicone and a silicone precursor. In the example of FIG. 1, the substance is silicone. A fluid 120 containing the selected substance is applied to the metal surface of the microwave circuit 100. A first exemplary method includes applying the silicone with a brush 110. Because the silicone is non-conductive, it has no effect on skin-effect conduction through the microwave device.

The silicone has low surface tension. Once applied, the liquid silicone spreads out at a rate on the order of centimeters per hour. Even if some isolated areas of the device are missed during the application, the silicone spreads out to form a monolayer that inhibits electrical discharges. This silicone layer is "self healing," i.e., if a local region of the silicone layer is disturbed or partially removed, the silicone surrounding that region flows in to replenish the silicone in that region. Thus, it may be preferable to wait for a (non-zero) period of time after applying the fluid 120 containing the selected substance, before transmitting microwave energy through the microwave circuit 100. This allows the self-healing layer of silicone to spread out, in the event that any spot is missed during the application step.

If the fluid is a liquid, a volatile solvent is preferred. An exemplary fluid includes about 0.5 percent silicone or more in a volatile solvent. The solvent may be, for example, alcohol, acetone, heptane, low-molecular-weight silicones, chlorofluorocarbons, fluorocarbons, naptha, and the like, or other volatile organic solvents well known to those of ordinary skill in the art.

A preferred substance includes a mercapto functional copolymer. Mercapto compounds covalently bind to copper, silver (which is applied to waveguide as a skin-effect conductivity surface coating) and gold (which is used in switch contacts). For example, poly (dimethyl-co-methylmercaptopropyl) siloxane is sold as product X-22-980 by Shin Etsu of Japan, or as silicone copolymer F-793 from Wacker Silicones, Adrian, Mich.

Figure 4:
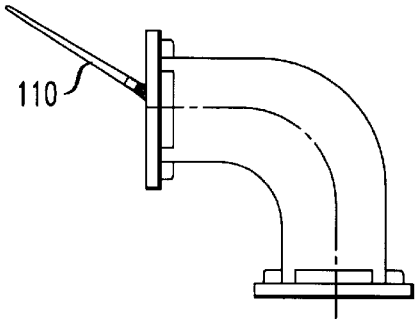
FIG. 4. shows an H-bend formed by the method.
Figure 5:
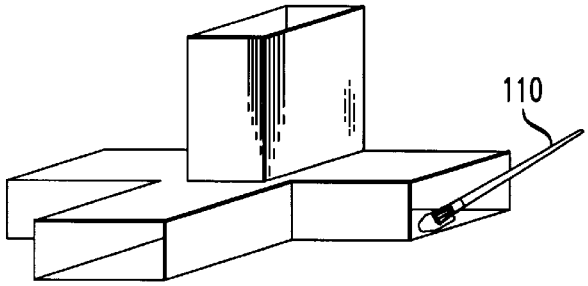
FIG. 5 shows a magic tee formed by the method.
Figure 6:
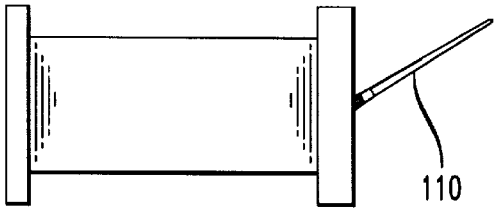
FIG. 6 shows a connector formed by the method.
Figure 7:
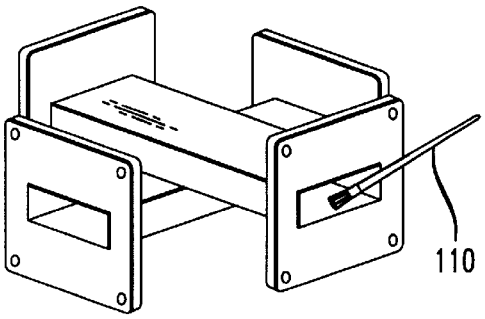
FIG. 7 shows a cross guide coupler formed by the method.
Figure 8:
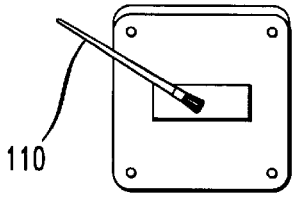
FIG. 8 shows a pressure window formed by the method.
Figure 9:
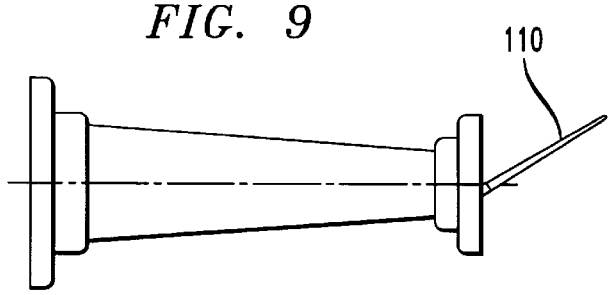
FIG. 9 shows an adapter formed by the method.
Figure 10:
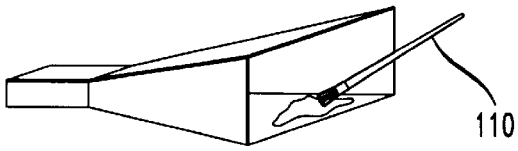
FIG. 10 shows a horn formed by the method.
Figure 11:
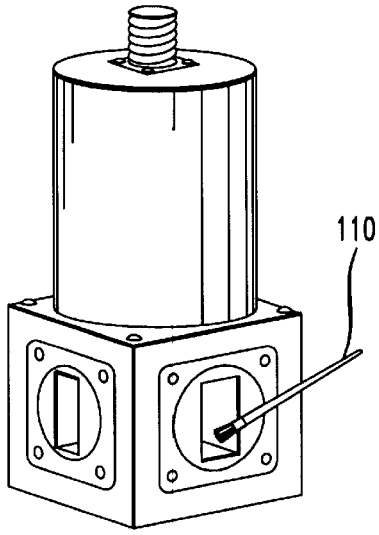
FIG. 11 shows a mechanical switch formed by the method.
Figure 12:
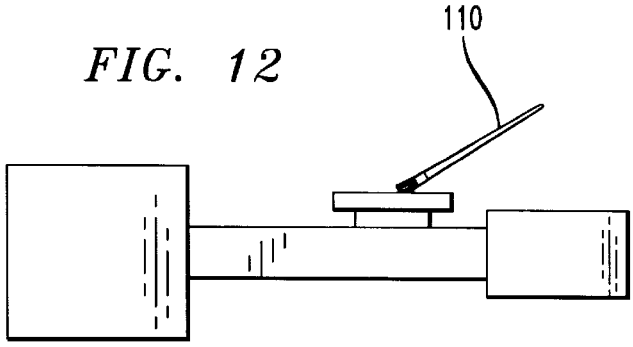
FIG. 12 shows a traveling wave tube amplifier formed by the method.

Although FIG. 1 shows a rectangular waveguide 100, the microwave circuit may include any conventional microwave guiding system in the form of a highly conductive tube or dielectric rod of arbitrary cross-section, through which electromagnetic energy is transmitted. Other known shapes (including, but not limited to, circular and elliptical) are also contemplated. Further, although the device 100 is a simple microwave conductor (i.e., a straight tube) other known waveguide devices, such as: e-bends (FIG. 3), h-bends (FIG. 4), magic tees (FIG. 5), connectors (FIG. 6), couplers (FIG. 7), windows (FIG. 8), adaptors (FIG. 9), horns (FIG. 10) and the like, may also be treated by the method. The microwave circuit may also include a switch (FIG. 11), or a transmitter or amplifier circuit (e.g., a traveling wave tube amplifier, shown in FIG. 12). Any assembly which includes one or more of the above-listed devices may also be treated by the method.

The device may be formed from any conventional waveguide material, and may optionally have a skin coating of a second metal. Exemplary materials include, but are not limited to, brass, aluminum, copper, silver, and gold.

Further, the device may be of a size for transmitting microwave energy within any band. Exemplary waveguide sizes include, but are not limited to, X-band, K-band and Ku-band.

Although the advantage of the discharge-reducing properties of the treated device becomes more apparent at higher power levels (such as 10 to 40 watts and higher for a horn), the treatment does not have any detrimental effects when the circuits are operated at lower power levels.

Figure 2:
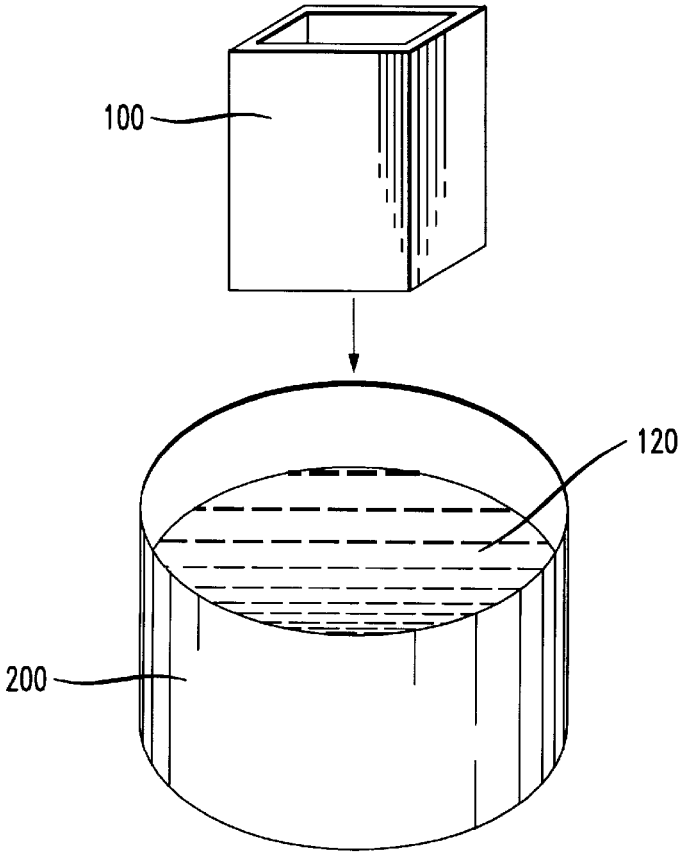
FIG. 2 shows application of a silicone layer to a microwave device by dipping, in an exemplary method according to the invention.

FIG. 2 shows a second exemplary method for applying the fluid 120 containing the silicone. In FIG. 2, the microwave device 100 is dipped or immersed in a container 200 containing the fluid. Dipping may be a quicker method of coating individual devices, and is likely to provide a relatively uniform coating, compared to brushing as in FIG. 1.

Figure 3:
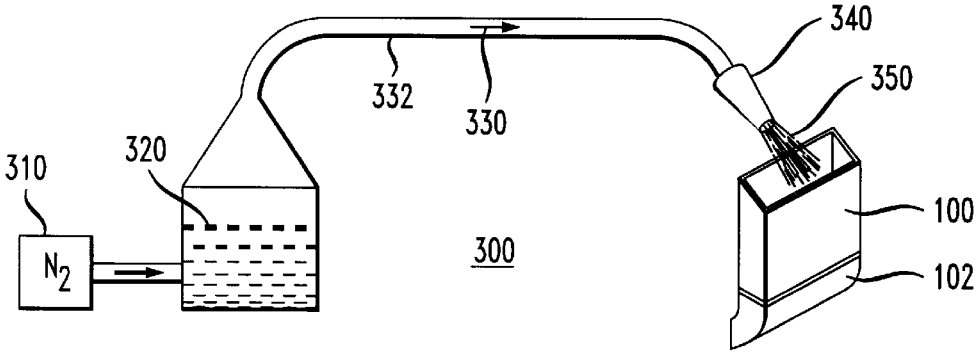
FIG. 3 is a block diagram showing application of a silicone or silicone precursor to a microwave device by applying a saturated gas through the device.

FIG. 3 shows a further method of applying the fluid to the microwave circuit that includes a waveguide 100 and an e-bend 102. In FIG. 3, the fluid is a saturated gas having liquid silicone or silicone precursor(s) suspended therein. One of ordinary skill in the field of thermodynamics recognizes that the term, "fluid," encompasses both liquids and gasses.

In the exemplary assembly 300 shown in FIG. 3, an inert gas 310 (which may be nitrogen) is bubbled through a liquid 320 containing a silicone precursor, to saturate the nitrogen. The saturated gas 330 flows through a suitable conduit means 332 to a nozzle 340. The saturated gas 330 is applied through the interior of the microwave devices 100 and 102. The saturated gas may contain the silicone or silicone precursor in the vapor state, in which case the vapor phase silicone or silicone precursor within the spray condenses on the surface of the devices 100 and 102.

The gas may also include excess liquid suspended in a spray 350, in which case, the liquid in the spray 350 is deposited on the device 100. If silicone precursors are deposited on the surface of the devices 100, 102, the precursor(s) form the silicone upon or after contact with the surface of the metal. For example, copper, silver and gold will bond to precursors containing mercapto groups. But the mixture may further comprise ammonia or volatile organic amines as catalysts. The precursors react with atmospheric moisture to condense to silicone polymers.

In an exemplary configuration, the liquid 320 may contain dimethyldimethoxysilane and dimethylmercaptopropyldimethoxysilane. Other precursors suitable for this purpose may include any of those listed in Table 1.

TABLE 1

| | |
|---|---|
| Cyclohexylethyldimethoxysilane | |
| Cyclohexylmethyldimethoxysilane | |
| Dicyclopentyldimethoxysilane | |
| Diethyldiethoxysilane | |
| Diisobutyldimethoxysilane | |
| Diisopropyldimethoxysilane | |
| Dimethyldiethoxysilane | |
| Diphenyldimethoxysilane | |
| Diphenylmethylethoxysilane | M |
| Dodecylmethyldiethoxysilane | |
| Mercaptomethylmethyldiethoxysilane | |
| Octadecyldimethyldiethoxysilane | M |
| Octadecylmethyldiethoxysilane | |
| Octylmethyldiethoxysilane | |
| Phenyldimethylethoxysilane | M |
| Phenylmethyldimethoxysilanes | |
| Trifluoropropylmethyldimethoxysilane | |
| Trimethylethoxysilane | M |
| Trimethylmethoxysilane | M |

M = monoalkoxy silanes, which can optionally be added in small quantities as chain termination agents to limit the length of the polysiloxane An advantage of using this variation of the method is that an assembly including a plurality of microwave devices may be treated at the same time. Although only two devices 100 and 102 are shown, more than two devices may be treated.

One of ordinary skill recognizes that the length of the treatment depend on the head loss of the assembly, and the density of the excess silicone (or silicone precursor) in the spray 350. For any given configuration of microwave devices, the treatment time can easily be determined without any undue experimentation.

Although three exemplary methods of applying the silicon or silicon precursor(s) to the microwave device are described above, other methods of applying the substance to the microwave circuit may be used by those of ordinary skill in the art within the scope of the invention.

According to another aspect of the invention, a microwave circuit has a metal surface on which there is a fluid containing a substance selected from the group consisting of a silicone and a silicone precursor. Thus, the invention also encompasses any device, circuit or assembly that has been treated by a method in accordance with the invention. A circuit, device or assembly according to the invention has advantageous resistance to electrical discharge due to multipaction.

The foregoing description merely illustrates the principles of the invention. It is thus appreciated that those of ordinary skill in the art are able to devise various arrangements which, although not explicitly described or shown herein, embody the principles of the invention and are included within its spirit and scope. Furthermore, all examples and conditional language recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. In a microwave circuit, the improvement comprising:

a metal surface of the microwave circuit having a layer of a fluid thereon, the layer of fluid containing a substance selected from the group consisting of a silicone and a silicone precursor, the fluid having a sufficiently low surface tension to form a self-healing layer.

2. The microwave circuit of claim 1, wherein the selected substance includes a mercapto functional copolymer.

3. The microwave circuit of claim 1, wherein the selected substance includes polydimethyl-co-methylmercaptopropyl siloxane.

4. The microwave circuit of claim 1, wherein the selected substance includes dimethyldimethoxysilane and dimethylmercaptopropyldimethoxysilane.

5. A microwave circuit treated by a process that comprises the steps of:

selecting a substance from the group consisting of a silicone and a silicone precursor;

applying a fluid containing the selected substance to a metal surface of the microwave circuit, the fluid having a sufficiently low surface tension to form a self-healing layer.

6. The microwave circuit of claim 5, wherein the microwave circuit includes at least a portion of a waveguide.

7. The microwave circuit of claim 5, wherein the process further comprises the step of:

waiting for a non-zero period of time after applying the fluid containing the selected substance, before transmitting microwave energy through the microwave circuit.

8. The microwave circuit of claim 5, wherein the selected substance includes a mercapto functional copolymer.

9. The microwave circuit of claim 5, wherein the selected substance includes polydimethyl-co-methylmercaptopropyl siloxane.

10. The microwave circuit of claim 5, wherein the fluid layer inhibits electrical discharges.

11. A microwave circuit treated by a process that comprises the steps of:

selecting a substance from the group consisting of a silicone and a silicone precursor;

applying a fluid containing the selected substance to a metal surface of the microwave circuit, wherein the applying step includes:

bubbling gas through a liquid containing a silicone precursor to saturate the gas; and blowing the saturated gas across the metal surface of the microwave circuit to deposit excess silicon or silicone precursor thereon.

12. The microwave circuit of claim 11, wherein the gas is nitrogen, and the liquid contains dimethyldimethoxysilane and dimethylmercaptopropyldimethoxysilane.

13. In a microwave circuit, the improvement comprising:

a metal surface of the microwave circuit having a layer of a fluid thereon, the layer of fluid containing a substance selected from the group consisting of a silicone and a silicone precursor, wherein the selected substance includes one of the group consisting of a mercapto functional copolymer, polydimethyl-co-methylmercaptopropyl siloxane, dimethyldimethoxysilane and dimethylmercaptopropyldimethoxysilane.

14. A microwave circuit treated by a process that comprises the steps of:

selecting a substance from the group consisting of a silicone and a silicone precursor;

applying a fluid containing the selected substance to a metal surface of the microwave circuit, wherein the fluid is a volatile solvent and the selected substance includes about 0.5 percent silicone.

* * * * *